US005568762A

United States Patent [19]

Manring

[11] Patent Number: 5,568,762

[45] Date of Patent: Oct. 29, 1996

[54] STABILIZING DEVICE FOR VARIABLE DISPLACEMENT AXIAL PISTON PUMPS

[75] Inventor: Noah D. Manring, Roland, Iowa

[73] Assignee: Caterpillar Inc., Peoria, Ill.

[21] Appl. No.: 421,584

[22] Filed: Apr. 12, 1995

[51] Int. Cl.[6] ..... F01B 29/00; F01B 3/00

[52] U.S. Cl. ..... 92/143; 91/499; 92/71

[58] Field of Search ..... 92/143, 255, 71; 91/499; 60/469

[56] References Cited

U.S. PATENT DOCUMENTS

| | | | |
|---|---|---|---|
| 850,583 | 4/1907 | Howard | 92/143 X |
| 1,487,965 | 3/1924 | Michell | 92/71 X |
| 1,857,750 | 5/1932 | Wilbur | 92/143 X |
| 2,980,077 | 4/1961 | Magill | 92/255 X |
| 3,648,570 | 3/1972 | Koch | 92/143 X |
| 4,090,478 | 5/1978 | Trimble et al. | 92/71 X |
| 5,007,332 | 4/1991 | Wagenseil | 92/255 X |
| 5,320,203 | 6/1994 | Wilber et al. | 60/469 X |

FOREIGN PATENT DOCUMENTS

| | | | |
|---|---|---|---|
| 1425783 | 8/1969 | Germany | 60/469 |
| 2705836 | 9/1977 | Germany | 92/143 |

*Primary Examiner*—John E. Ryznic
*Attorney, Agent, or Firm*—John W. Grant

[57] ABSTRACT

A piston for a variable displacement axial piston hydraulic pump has a vibration absorber disposed within a chamber of the piston. The vibration absorber includes a vibration absorber mass suspended between a pair of springs. The vibration absorber offsets the piston inertia created from the oscillatory displacement of the pistons for stabilizing the pump.

5 Claims, 1 Drawing Sheet

STABILIZING DEVICE FOR VARIABLE DISPLACEMENT AXIAL PISTON PUMPS

TECHNICAL FIELD

This invention relates to variable displacement axial piston hydraulic pumps and, more particularly, to a stabilizing device incorporated within the pistons thereof.

BACKGROUND ART

Some variable displacement axial piston hydraulic pump designs utilize the naturally occurring swivel torque as a means for controlling pump displacement. This eliminates the need for the conventional hydraulic actuators normally used for controlling swashplate position to change pump displacement, thereby reducing the size of the pump and increasing pump efficiency.

One of the problems associated with elimination of the hydraulic actuator is that the stabilizing effect resulting from the actuator bulk modulus is also eliminated causing the pump to become unstable. Upon analyzing the problem, it was found that piston inertia created from the oscillating displacement of the piston itself is responsible for driving variable displacement pumps unstable. In general, this inertia produces a torque on the swashplate that may be expressed as:

$$T=\frac{N}{2}\,Mr^2s^2a$$

wherein:

T= inertial torque on the swashplate

N= number of pistons

M= piston mass r= piston pitch radius s= pump rotational speed a= swashplate angle.

The inertial torque described by this equation drives the pump unstable because of its positive sign.

Analysis has shown that making the torque value negative, or at least zero, would make the pump completely stable. Thus, it would be desirable to provide a piston that creates a neutral or negative inertial torque rather than a positive one. Further, since the object of eliminating the hydraulic actuator was to reduce the size of the pump, the new piston must not consume any more space than the present piston.

DISCLOSURE OF THE INVENTION

In one aspect of the present invention, a piston for a variable displacement axial piston hydraulic pump comprises a cylindrical body having a chamber defined therein and a vibration absorber disposed within the chamber.

BEST MODE FOR CARRYING OUT THE INVENTION

Figure 1:
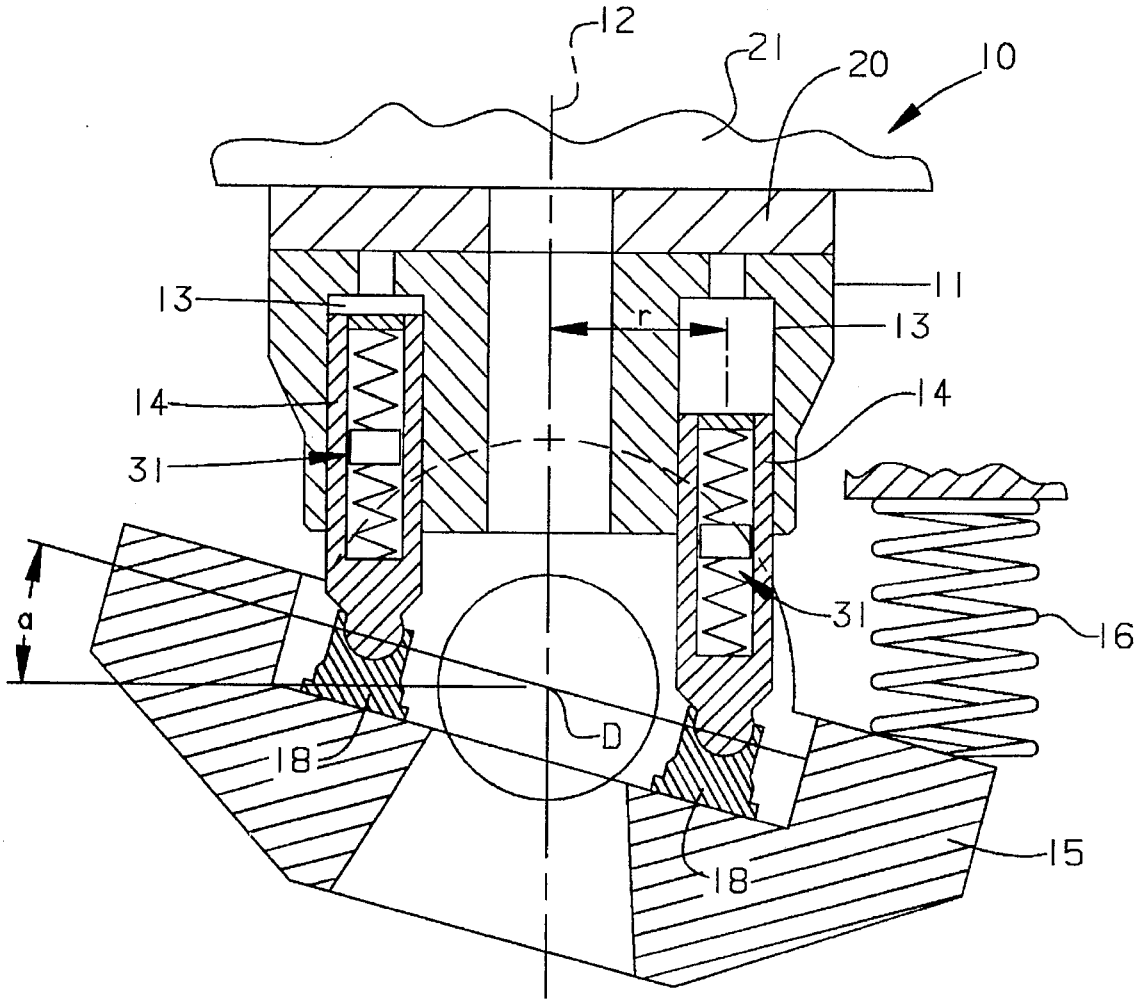
FIG. 1 is a diagrammatic sectional view of a variable displacement axial piston hydraulic unit illustrating an embodiment of the present invention.

A variable displacement axial piston hydraulic unit is generally indicated by the reference numeral 10. The hydraulic unit 10 can be either a pump or a motor but in this embodiment is described as a hydraulic pump having a cylinder barrel 11 rotatable about an axis 12. The cylinder barrel has a plurality of equally spaced circumferentially arranged piston bores 13 provided therein. Each of a plurality of pistons 14 are disposed for oscillatory movement within the respective piston bores 13. A swashplate is conventionally mounted adjacent one end of the cylinder barrel for tilting movement about an axis D to adjust the stroke of the pistons. The swashplate is continuously biased toward the maximum displacement position by a spring 16. A ball and socket joint connects the base of each piston to a slipper 18 maintained in sliding contact with the swashplate in the usual manner. A flat timing port plate 20 is disposed between the other end of the cylinder barrel and stationary head 21.

Figure 2:
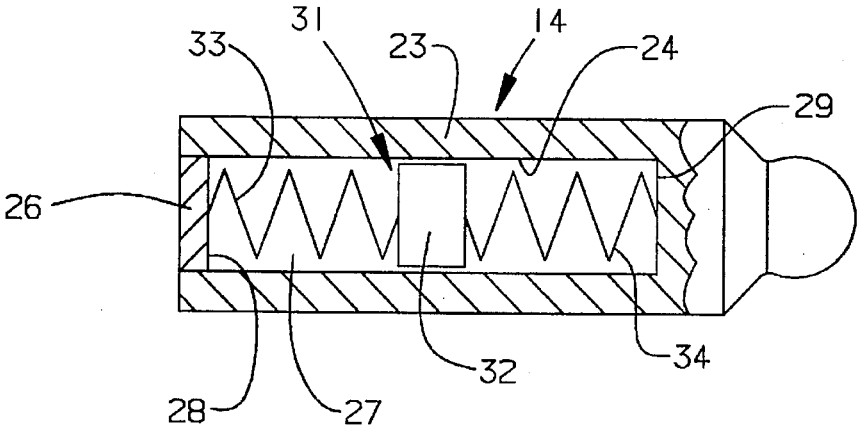
FIG. 2 is a somewhat enlarged sectional view of a piston of the hydraulic unit of FIG. 1.

Referring now to FIG. 2, each of the pistons 14 includes a cylindrical body 23 having a bore 24 therein. A plug 26 disposed within the open end of the bore 24 is suitably secured to the cylindrical body and defines a chamber 27 having opposite end walls 28,29. A vibration absorber 31 is disposed within the chamber and includes a vibration absorber mass 32 suspended between a pair of compression springs 33,34. Alternatively, the mass can be suspended between a pair of tension springs each having an end suitably connected to the end walls 28,29.

INDUSTRIAL APPLICABILITY

In use, the vibration absorber 31 offsets the piston inertia created by the oscillatory displacement of the pistons for stabilizing the pump. The dynamics of the vibration absorber 31, coupled with the dynamics of the oscillating piston 14, represent a fourth order system with the inertial torque generated on the swashplate by the pistons 14 expressed as:

$$T=\frac{N}{2}\left\{Mr^2s^2a-kr^2a\left[1+\frac{1}{(s/F)^2-1}\right]\right\}$$

wherein:

T= inertial torque on the swashplate

N= number of pistons m= vibration absorber mass r= piston pitch radius s= pump rotational speed a= swashplate angle k= vibration absorber spring constant F= natural frequency of the vibration absorber and $$F^2=\frac{k}{m}$$

From the above, it is readily apparent that the contribution of the properly designed vibration absorber will generate a negative inertial torque. To insure good stability, the natural frequency ratio should be designed as follows:

$$1<(s/F)^2<2$$

Other aspects, objects and advantages of this invention can be obtained from a study of the drawings, the disclosure and the appended claims.

I claim:

1. A variable displacement axial piston hydraulic pump comprising:

a rotatable cylinder barrel having a plurality of circumferentially arranged piston bores therein;

a plurality of pistons disposed for oscillatory movement within the piston bores, each of the pistons including a cylindrical body having a chamber defined therein; and a vibration absorber disposed within the chamber.

2. The pump of claim 1 wherein the vibration absorber includes a pair of springs disposed within the chamber and a vibration absorber mass disposed between the pair of springs.

3. The pump of claim 2 wherein the chamber is formed by an axially extending bore and a pair of opposite end walls.

4. A variable displacement axial piston hydraulic pump comprising:

a rotatable cylinder barrel having a plurality of circumferentially arranged piston bores therein;

plurality of pistons disposed for oscillatory movement within the piston bores, each of the pistons including a cylindrical body having a chamber defined therein; and a vibration absorber disposed within the chamber wherein the vibration absorber has a natural frequency expressed in the equation:

$$1<(s/F)^2<2$$

wherein:

s= pump rotational speed; and

F= natural frequency of the vibration absorber.

5. The pump of claim 1 wherein the vibration absorber has a natural frequency expressed in the equation:

$$F^2=\frac{k}{m}$$

wherein:

F= natural frequency of the vibration absorber;

k= vibration absorber spring constant; and m= vibration absorber mass.

* * * * *